US005301951A

United States Patent [19]

Morell

[11] Patent Number: 5,301,951

[45] Date of Patent: Apr. 12, 1994

[54] GOLF BALL

[75] Inventor: Joseph Morell, Annecy le Vieux, France

[73] Assignee: Taylor Made Golf Company, Inc., Carlsbad, Calif.

[21] Appl. No.: 936,729

[22] Filed: Aug. 31, 1992

Related U.S. Application Data

[63] Continuation of Ser. No. 700,440, May 15, 1991, abandoned.

[30] Foreign Application Priority Data

May 16, 1990 [FR] France ..... 90 06131

[51] Int. Cl.[5] ..... A63B 37/14

[52] U.S. Cl. ..... 273/232; 40/327

[58] Field of Search ..... 273/232, 220; 40/327

[56] References Cited

U.S. PATENT DOCUMENTS

| | | | |
|---|---|---|---|
| 4,284,276 | 8/1981 | Worst | 273/232 |
| 4,560,168 | 12/1985 | Aoyama | 273/232 |
| 4,720,111 | 1/1988 | Yamada | 273/232 |
| 4,772,026 | 9/1988 | Gobush | 273/232 |
| 5,064,199 | 11/1991 | Morell | 273/232 |

FOREIGN PATENT DOCUMENTS

| | | | |
|---|---|---|---|
| 2555061 | 5/1985 | France | 273/232 |
| 2639550 | 6/1990 | France . | |
| 189551 | 12/1922 | United Kingdom | 273/232 |
| 2150840 | 7/1985 | United Kingdom | 273/232 |
| 2205247 | 12/1988 | United Kingdom | 273/232 |
| 2216017 | 10/1989 | United Kingdom | 273/232 |
| 2225242 | 5/1990 | United Kingdom . | |
| 2225243 | 5/1990 | United Kingdom . | |
| 2225244 | 5/1990 | United Kingdom . | |
| 2225245 | 5/1990 | United Kingdom . | |

*Primary Examiner*—George J. Marlo

*Attorney, Agent, or Firm*—Sandler, Greenblum & Bernstein

[57] ABSTRACT

The present invention relates to a golf ball.

The peripheral surface of the ball has dimples defining, at their intersections with this peripheral surface, circles of intersection distributed for the most part over the interior of twenty-four first elementary surfaces in the form of an irregular spherical quadrilateral, identical or constituting mutual mirror images, of eight second identical elementary surfaces in the form of spherical equilateral triangle and of twenty-four third elementary surfaces in the form of a spherical rectangular triangle, which are identical or constituting mutual mirror images, these elementary surfaces being defined by nine equatorial circles of the sphere defining the general shape of the peripheral surface of the ball. By a careful selection of the relative position of the equatorial circles, the distribution and diameters of the circles of intersection, one can render the orientation of the ball relatively indifferent with respect to the impact on the ball.

20 Claims, 4 Drawing Sheets

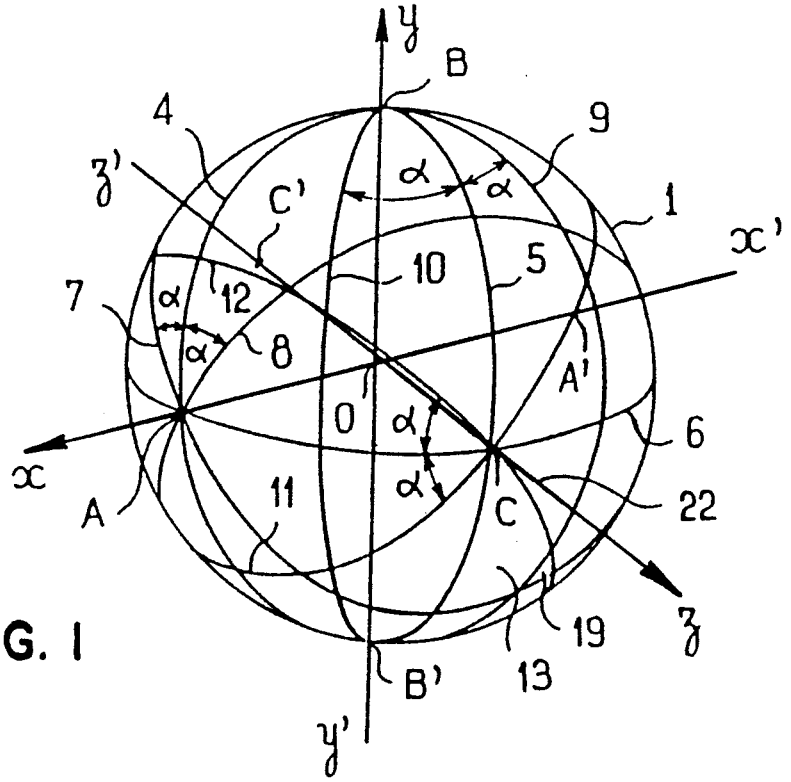
FIG. 1
FIG. 2
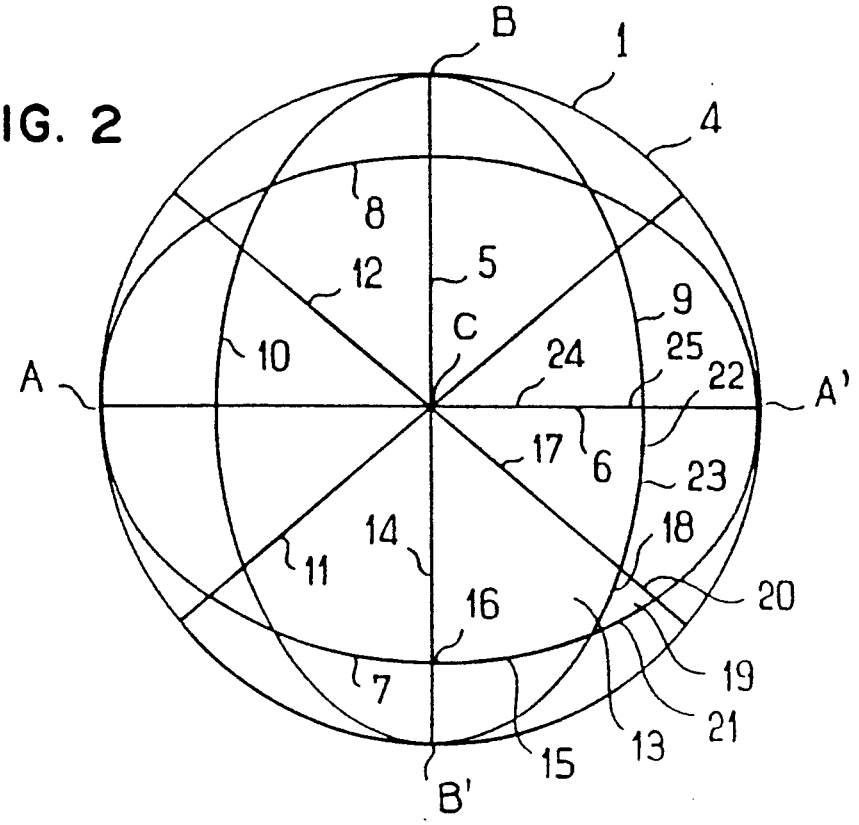

GOLF BALL

This application is a continuation of application Ser. No. 07/700,440, filed May 15, 1991, now abandoned.

BACKGROUND OF THE INVENTION

I. Field of the Invention

The present invention is related to a golf ball, of the type having a peripheral surface having the general shape of a sphere and a plurality of dimples or hollows provided in the peripheral surface and defining, through their intersections with the surface, circles of intersection distributed on the peripheral surface according to a repeating pattern, essentially within elementary surfaces defined by nine equatorial arcs of a circle of the sphere, by virtue of:

three equatorial circles constituting their respective intersections, with the sphere, of three secant equatorial planes two-by-two, at right angles along axes which are themselves secant two-by-two, at right angles to the center of the sphere;

six equatorial circles distributed in three groups of which each is associated on the one hand with one, respectively, of the equatorial planes and on the other hand with one, respectively, of the axes, each group comprising two equatorial circles secant to the respectively correspondent axes, mutually symmetrical with respect to the corresponding respective equatorial plane and angularly offset, with respect thereto, by an angle $\alpha$ which is not zero and which is less than 90° identical from one group to the other.

II. Description of Background and General Information

A golf ball of aforementioned type is described in French application 88 15571 in the name of the Applicant, in a particular case according to which the angle $\alpha$ is equal to 45°, consequently with a particular construction of nine equatorial circles, beginning with a cube inscribed in a sphere.

Such a value of the angle $\alpha$ results in a subdivision of a peripheral surface of the ball into 48 identical elementary surfaces, in a form of a spherical rectangular triangle, in which the hollows are distributed, at least for the most part.

This method of subdividing the peripheral surface of the ball into an elementary surface provides progress with respect to other types of subdivision, previously known, utilizing a cube inscribed in the sphere corresponding to the peripheral surface of the ball, in that it is more precise and makes it thus possible to increase the homogeneity of the distribution of the hollows and to reduce the fields of the spherical periphery surface of the golf ball which exist between these dimples, which has as a consequence to provide a character which is as unvariable as possible with respect to the orientation of the ball with respect to the hit.

SUMMARY OF THE INVENTION

An object of the present invention is to perfect the ball described in the above-mentioned French application, the disclosure of which is hereby expressly incorporated by reference thereto, by achieving an even finer subdivision of the peripheral surface of this ball, beginning with the same number of equatorial circles.

To this end, the ball according to the invention, of the type indicated above, is characterized in that the angle $\alpha$ is different than 45° such that the arcs of the nine equatorial circles define:

24 first elementary surfaces, which are identical or which constitute mutual mirror images with respect to three equatorial planes, in the form of an irregular spherical quadrilateral having a right angle;

8 second identical elementary surfaces, in the form of a spherical equilateral triangle; and 24 third elementary surfaces which are identical or which constitute mutual mirror images with respect to three equatorial planes, in the form of a spherical right triangle.

It will be easily understood that the distribution of the circles of intersection, i.e., likewise the dimples, for the most part within the more numerous elementary surfaces, makes it possible to refine the distribution of the circles of intersection, i.e., the dimples, on the spherical peripheral surface of the golf ball, and thus to make it possible to reduce the fields of this spherical peripheral surface which exist between the circles of intersection, i.e., between the dimples.

As long as one avoids, for the angle of angular offset of the two equilateral circles of each group with respect to the corresponding respective equatorial plane, values of 0° and 90°, corresponding to a subdivision of the peripheral surface of the sphere into 8 elementary surfaces only, as well as the value of 45°, corresponding to the subdivision described in the above-mentioned French patent application, any value of the angle of angular offset can be selected and associated with respective distribution patterns of the circles of intersection, i.e., the dimples, in the various elementary surfaces. Preferably, these patterns are identical for identical elementary surfaces, while elementary surfaces constituting mirror images of one another preferably have patterns which likewise constitute mutual mirror images.

However, a value on the order of 34°47′ is actually preferred for this angle, this number being indicated by way of a non-limiting example.

In the same way as the subdivision described in the above French patent application, the subdivision provided according to the present application is preferable in terms of ease of manufacture of the ball.

In effect, by virtue of the homogeneity obtained in the distribution in the circles of intersection, i.e., the dimples, it is possible that at least one predetermined equatorial circle, amongst the said equatorial circles, does not cut any circle of intersection. This predetermined circle can correspond to a junction plane when the ball is formed by the assembly in two identical halves or when at least one superficial layer thereof, comprising the dimples, is formed by molding of a single piece in a mold which is itself formed of two identical assembled halves. One can then provide that one of the halves of the ball or of the mold, respectively, is angularly offset with respect to the other half around the axis of the equatorial circle defined as noted previously. This angular offset remains practically without consequence, the orientation of the ball during impact being relatively unaffected by virtue of practicing the present invention.

Naturally, in the case of such an angular offset, the said predetermined equatorial circle subdivides each of the other said equatorial circles into two arcs of a circle, of which each corresponds to one of the two hemispheres defined by the predetermined equatorial circle, and the arcs of the equatorial circle of one of the hemispheres are angularly offset, with respect to the respectively corresponding equatorial arcs of circle of the other of the hemispheres, by the same value around the axis of the said predetermined equatorial circle.

By allowing such an arrangement considerably facilitates the manufacture of the ball by assembly of the two halves or by molding in one mold formed of two assembled halves, because it is not necessary to perform a precise adjustment of the relative angular position of the two halves of the ball or of the mold, respectively, during manufacture of the ball.

Naturally, one can likewise provide that none of the equatorial circles cuts a circle of intersection.

Further, one can provide that the ball according to the invention comprises circles of intersection at least at some of the mutual intersections of the said equatorial circles, which makes it possible to avoid the possible existence of fields on the peripheral spherical surface between the circles of intersections, i.e., between the dimples, at the area of the mutual intersections. Naturally, this choice remains compatible with the ability to leave one of the said equatorial circles free of any circle of intersection to make it correspond to a junction plane as was indicated above, even though it is likewise possible to provide a circle of intersection, respectively, at each mutual intersection of the said equatorial circles.

BRIEF DESCRIPTION OF DRAWINGS

Other characteristics and advantages of the ball according to the present invention will become clear from the description below with reference to three alternative presently preferred embodiments; however, it is to be understood that these embodiments are not limiting for performing the invention, and are illustrated only for purposes of making it possible to better understand the invention with the assistance of the annexed drawings which form an integral part of the instant application.

FIG. 1 illustrates the construction, according to the present invention, of nine equatorial circles on a sphere;

FIG. 2 illustrates these nine equatorial circles;

DESCRIPTION OF PREFERRED EMBODIMENTS

Figure 3:
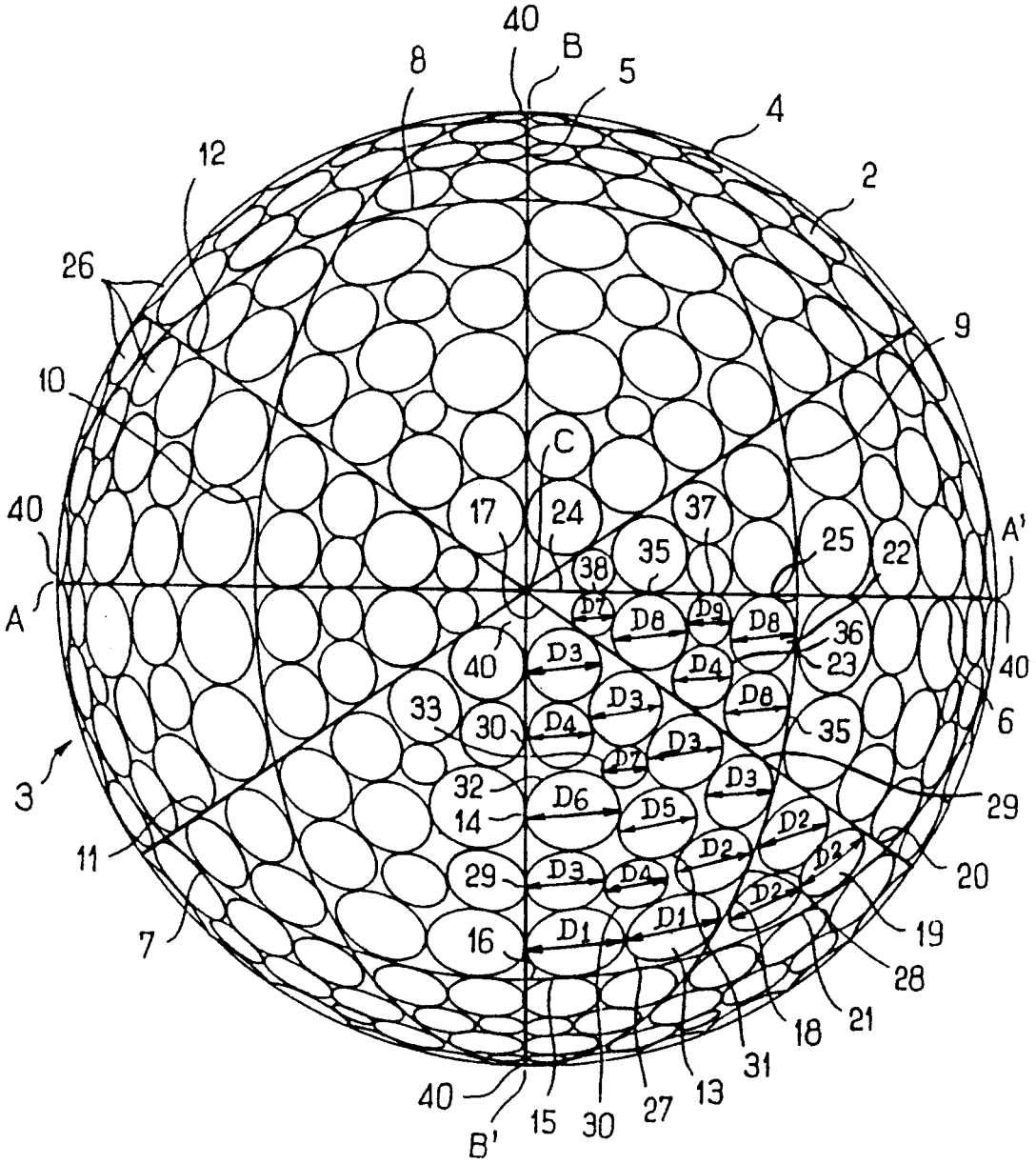
FIG. 3 illustrates a golf ball whose dimples, or more precisely the circles of intersection of these dimples with the peripheral surface of the ball, are distributed in the elementary surfaces obtained by this subdivision by means of nine equatorial circles, of which each does not cut a circle of intersection.

In FIGS. 1 and 2, a sphere 1 forms the general form of spherical surface 2 of a golf ball 3 illustrated in FIG. 3. In FIG. 1 there has been further designated the center O of the sphere and, by x'x, y'y, z'z, respectively, three axes cutting one another two-by-two, at a right angle, at the center O of the sphere 1. Two-by-two, these axes define three equatorial planes which are likewise secant two-by-two at a right angle, namely the plane xOy secant to the sphere 1 along an equatorial circle 4, the plane yOz secant to the sphere 1 along an equatorial circle 5 and the plane zOx secant to the sphere 1 along an equatorial circle 6.

According to the present invention, traced on the sphere 1, in addition to the three equatorial circles 4, 5, 6, previously discussed, are six equatorial circles distributed into three groups of which each is associated with one, respectively, of the planes xOy, yOz, and zOx, as well as to one, respectively, of the axes x'x, y'y, and z'z.

More precisely, if one designates by A' and A the points of intersection of the axes x'x with the sphere 1, as well as with the equatorial circles 6 and 4, by B' and B the points of intersection of axis y'y with sphere and with the equatorial circles 4 and 5, and by C' and C the points of intersection of the axis z'z with the sphere 1 and with the equatorial circles 5 and 6, one traces on the sphere 1:

two equatorial circles 7, 8 which are mutually secant to the points A' and A and mutually symmetrical with respect to the plane xOy, with respect to which they are angularly offset, around axis x'x, of the same angle $\alpha$;

two equatorial circles 9 and 10 which are mutually secant to the points B' and B and symmetrical to one another with respect to the plane yOz, with respect to which they are angularly offset around the axis y'y of the same angle $\alpha$ as the equatorial circles 7 and 8 with respect to the plane xOy;

two equatorial circles 11 and 12 which are mutually secant to the points C' and C and angularly offset with respect to the plane zOx, around the axis z'z of the same angle $\alpha$ as the equatorial circles 7 and 8 and the equatorial circles 9 and 10 with respect to the plane xOy and to the plane yOz, respectively.

The nine equatorial circles 4, 5, 6, 7, 8, 9, 10, 11, 12 have likewise been illustrated in FIG. 2 as well as in FIG. 3 on the peripheral spherical surface 2 of the golf ball 3, but it will be noted that it is not necessary that these circles be formed on this surface 2.

According to the present invention, the angle $\alpha$ is included between 0° and 90° but it is different from 0°, from 45° and from 90°.

Thus, the nine equatorial circles 4, 5, 6, 7, 8, 9, 10, 11, 12 mutually cut one another while defining, on the peripheral spherical surface 2 of the golf ball 3, elementary surfaces in the form of a spherical polygon whose arcs of a circle constitute the sides, namely:

twenty-four primary elementary surfaces 13 in the form of an irregular spherical quadrilateral, by virtue of twelve primary elementary surfaces 13 which are mutually identical and constitute mirror images of twelve other elementary primary surfaces 13 with respect to the equatorial planes xOy, yOz, zOx, each of these twenty-four elementary primary surfaces 13 being defined by a first arc 14 belonging to one of the equatorial circles 4, 5, 6, and common to another first elementary surface 13, a second arc 15 belonging to one of the equatorial circles 7, 8, 9, 10, 11, 12 adjacent to the arc 14 and defining therewith a right angle 16, and third and fourth arcs 17 and 18 belonging to two of the equatorial circles 7, 8, 9, 10, 11, 12 which are respectively adjacent to the arc 14, and to the arc 15, and are mutually adjacent;

eight second identical elementary surfaces 19 in the form of a spherical equilateral triangle, i.e., defined by three arcs of a circle 18, 20, 21 which belong to one, respectively, of the equatorial circles 7, 8, 9, 10, 11, 12, having the same length and each aligned with a fourth arc of a circle of a first respective elementary surface 13;

twenty-four third elementary surfaces 22 in the form of a spherical right triangle, by virtue of twelve third identical elementary surfaces 22 and twelve third elementary surfaces 22 which are mutually identical and constitute mirror images of 12 other third elementary surfaces 22 with respect to the equatorial planes xOy, yOz, zOx, each of these twenty-four third elementary surfaces 22 being defined by a first arc of a circle 17 forming a base, aligned with the third arc of a circle of a first elementary surface 13, respectively, by a second arc of a circle 23 aligned with the second arc of a circle of another primary elementary surface 13 respectively, and by a third arc of a circle 24 of an equatorial circle 4, 5, 6, respectively, common to another third elementary surface 22 respectively, the second and third arcs of a circle 23 and 24 defining between them a right angle 25.

In a manner known in and of itself, in the peripheral spherical surface 2 of ball 3 are provided hollows or dimples 26 which have, for example, the shape of spherical recesses and define circles by virtue of their intersection with this peripheral surface 2.

According to the present invention, the circles of intersection thus defined are distributed along patterns defined within the elementary surfaces 13, 19, 22, without overlapping any of the equatorial circles 4, 5, 6, 7, 8, 9, 10, 11, 12 in the example illustrated, even though an overlapping is possible to a certain extent within the scope of the invention. Preferably, however, at least one of the equatorial circles does not cut any of the circles of intersection of the dimples with the peripheral surface 2 of the ball 3 to correspond to a junction plane between two halves of the ball if the ball is formed of two halves, or between two halves of a mold adapted to form the ball, or at least one superficial layer thereof comprising the dimples, from a single piece by molding. In a manner not shown, this predetermined equatorial circle can then subdivide each of the other equatorial circles into two equatorial arcs of a circle which are mutually angularly offset, by the same value, around the axis (not shown) of this equatorial circle, which causes no major inconvenience as indicated above.

Preferably, and without going beyond the scope of the present invention by adopting a different arrangement, the respective patterns of distribution of the dimples, i.e., of the circles of intersection of the latter with the peripheral surface of the ball, are identical with respect to a first elementary surface 13, having another first identical elementary surface 13 constituting mutual mirror images, with respect to the planes xOy, yOz, zOx, for the primary elementary surfaces 13, which themselves constitute mutual mirror images with respect to these planes. Likewise, the respective patterns are identical from one second elementary surface 19 to the other and from one third elementary surface 22 to another third elementary surface 22 which is identical, constituting mutual mirror images, with respect to the planes xOy, yOz, zOx for the third elementary surfaces 22 themselves constituting mutual mirror images with respect to these planes. The method of performing the invention illustrated in FIG. 3 adopts this preferred arrangement, in a manner which will be described below in greater detail.

This method of performing the invention corresponds to a preferred case in which the value of the angle $\alpha$ is on the order of 34°47′, for a diameter on the order of 42.67 mm regarding the peripheral surface 2 of the ball 3, it being understood that one would not go beyond the scope of the present invention by adopting different values, within the limits indicated above with respect to the angle.

In the case of this embodiment, each first elementary surface 13 comprises 13 circles of intersection distributed as follows:

two circles of intersection 27 of the same diameter $D_1$ on the order of 2.25 mm, mutually adjacent and of which the first is adjacent to the first and second arcs of a circle 14 and 15 of the first elementary surface 13, while the second is adjacent to the second and fourth arcs of a circle 15, 18 thereof;

one circle of intersection 28 having a diameter $D_2$ on the order of 1.90 mm adjacent to the second circle of intersection 27 of diameter $D_1$ indicated above as well as to the fourth arc of a circle 18 of the first elementary surface 13;

five circles of intersection 29 of the same diameter $D_3$ on the order of 1.75 mm, of which a first is adjacent to a first circle of intersection 27 of diameter $D_1$ as well as that of the first arc of a circle 14 of the first elementary surface 13, while the four others are mutually adjacent and adjacent to the third arc of a circle 17 of this first elementary surface 13, one of them being furthermore adjacent to the circle 28 of the diameter $D_2$ referred to above, as well as to the fourth arc of the circle 18 of the first elementary surface 13 and another of them being additionally adjacent to the first arc of circle 14 thereof;

two circles of intersection 30 of a diameter $D_4$ on the order of 1.50 mm, of which a first is adjacent on the one hand to the second circle of intersection 27 of diameter $D_1$ discussed above and on the other hand to the first circle of intersection 29 of diameter $D_3$ discussed above, while the second is adjacent on the one hand to a first arc of a circle 14 of the first elementary surface 13 and on the other hand to two circles of intersection 29 of diameter $D_3$ which are mutually adjacent, of which the one of these circles of intersection 29 of diameter $D_3$ which is adjacent to the first and third arcs of circles 14 and 17 thereof;

one circle of intersection 31 of a diameter $D_5$ on the order of 1.80 mm, adjacent both to the circle of intersection 28 of diameter $D_2$ to one of the circles of intersection 29 which are adjacent to the third arc of circle 17 of the first elementary surface 13 without being adjacent either to the first arc of circle 14 thereof or to the fourth arc circle 18, and to the first intersection circle 30 of diameter $D_4$ discussed above;

one circle of intersection 32 of a diameter $D_6$ on the order of 2.15 mm, adjacent on the one hand to the first arc of circle 14 of the first elementary surface 13 and on the other hand to the circle of intersection 29 of diameter $D_3$ discussed above, to the second circle of intersection 30 of diameter $D_4$ discussed above and to the circle of intersection 31 of diameter $D_5$;

one circle of intersection 33 of diameter $D_7$ on the order of 1.00 mm, adjacent to a circle of intersection 32 of diameter $D_6$ as well as to two circles of intersection 29 of diameter $D_3$ which are adjacent to the third arc of circle 17 without being adjacent to the first and fourth arcs of circle 14 and 17 thereof.

In a general manner, in what has proceeded as in what will follow, it is understood by being "adjacent", with respect to the circles of intersection of a dimple with the peripheral surface 2 of the ball 3 either two-by-two, or with respect to an arc of a circle defining the elementary surface which essentially contains them, a tangential relation or a mutual spacing which is small with respect to the diameter of the circles of intersection which are concerned, and, for example, at most equal to a quarter of this diameter, this number being indicated by way of non-limiting example only.

In the example illustrated, furthermore, each second elementary surface 19 comprises three circles of intersection 34 which are mutually adjacent, of the diameter $D_2$ discussed above on the order of 1.90 mm, of which each is adjacent to two of the three arcs of a circle 18, 20, 21 of the second elementary surface 19.

Finally, each third elementary surface 22 comprises six circles of intersection distributed into:

three circles of intersection 35 of a diameter $D_8$ on the order of 1.72 mm of which a first is adjacent to the first and third arcs of circles 17, 24, of the second elementary surface 22 and of which a second and third are mutually adjacent to the second arc of circle 23 thereof and furthermore respectively adjacent at its first arc of circle 17 and at its second arc of circle 22;

one circle of intersection 36 of diameter $D_4$ discussed above on the order of 1.50 mm, adjacent to the first and second circles of intersection 35 of diameter $D_8$ discussed above, as well as to the first arc of circle 17 of the third elementary surface 22;

one circle of intersection 37 of a diameter $D_9$ on the order of 1.10 mm, adjacent to the first and third circles of intersection 35 of diameter $D_8$ mentioned above, as well as to the third arc of circle 24 of the third elementary surface 22 and to the circle of intersection 36 of diameter $D_4$;

one circle of intersection 38 of a diameter $D_7$ discussed above on the order of 1.80 mm, adjacent to the first circle of intersection 35 of diameter $D_8$ discussed above, as well as to the first and the third arcs of circles 17, 24 of the second elementary surface 22.

When, as is the case in the arrangement which has just been described, the relatively substantial fields 40 of peripheral spherical surface 2 of the ball 3 exist at the mutual intersections of the equatorial circles 4, 5, 6, 7, 8, 9, 10, 11, 12, namely around points A, A', B, B', C, C' in the case of the arrangement which has just been described. One can likewise contemplate providing supplemental dimples 26 around at least certain of the mutual intersections of the equatorial circles 4, 5, 6, 7, 8, 9, 10, 11, 12, preferably by leaving at least one of them free of such dimples 26 to correspond to a junction plane as was indicated above.

Such a possibility has been illustrated in FIGS. 4 and 5 where one furthermore finds, identically and using the same numerical references in part, the arrangements described with reference to FIG. 3.

Figure 4:
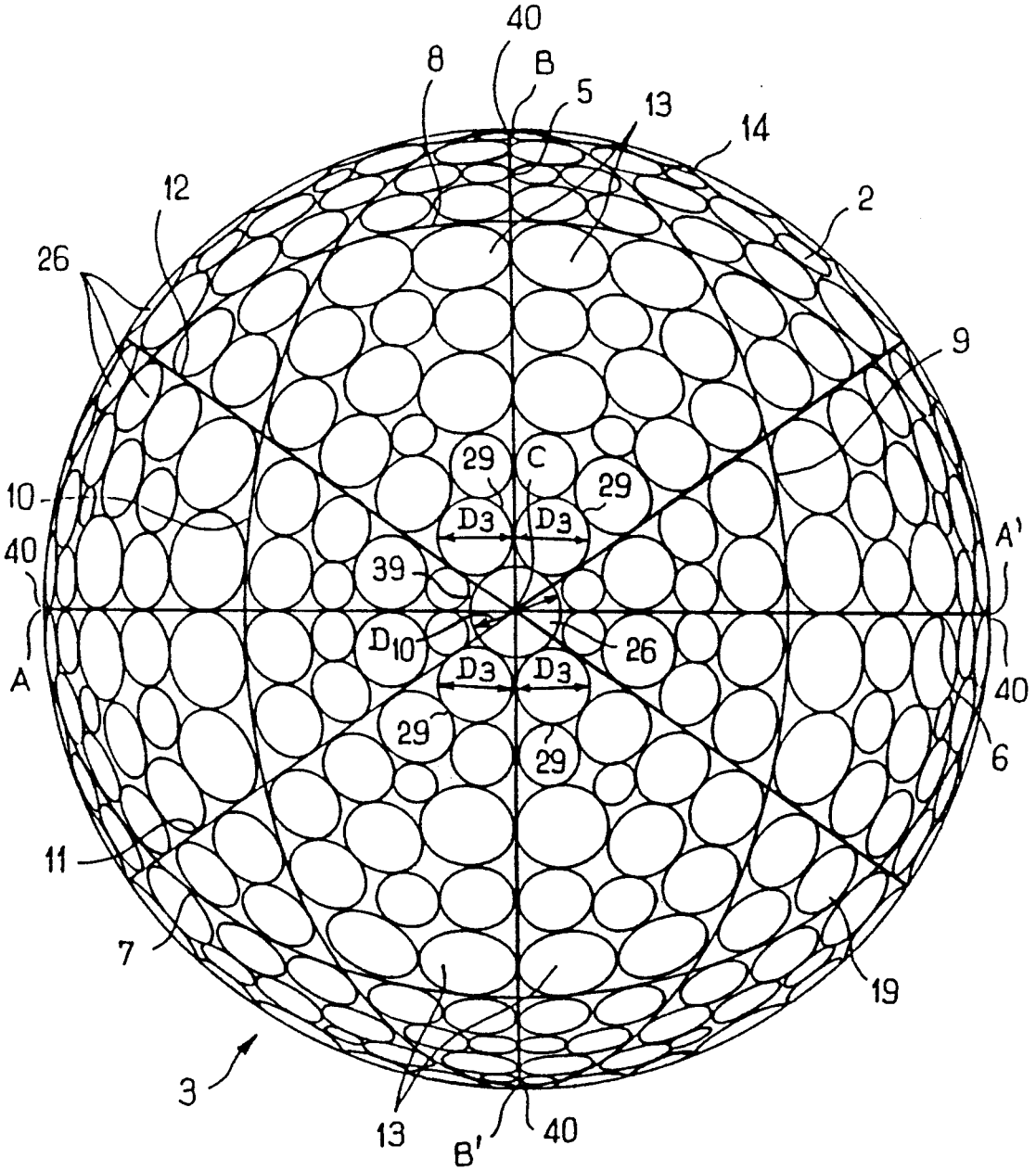
FIGS. 4 and 5 illustrate a ball identical to that of FIG. 3 except that it further comprises circles of intersection having certain intersections of the nine previously cited equatorial circles, of which, however, one remains free of any circle of intersection.

Thus, FIG. 4 illustrates a golf ball 103 identical to that which has been described with reference to FIG. 3 except that this one comprises two supplementary dimples 26 respectively provided around point C, visible, and point C', not visible. Each of these supplemental dimples 26 defines by virtue of its intersection with the peripheral spherical surface 2 of the golf ball 103 a respective circle of intersection 39 adjacent to a respective circle of intersection 29 of diameter $D_3$, of four first elementary surfaces 13, this circle of intersection 39 having a diameter $D_{10}$ on the order of 4.00 mm when the diameters $D_1$–$D_9$ have the values noted above, these values being indicated by way of non-limiting example only. In this case, the relatively substantial fields 40 exist only around points A, A', B, B' of the peripheral spherical surface 2 of the golf ball 103, for example so as to allow for a marking thereof, while the equatorial circles 4 and 7–10 remain free of any dimples 26.

Figure 5:
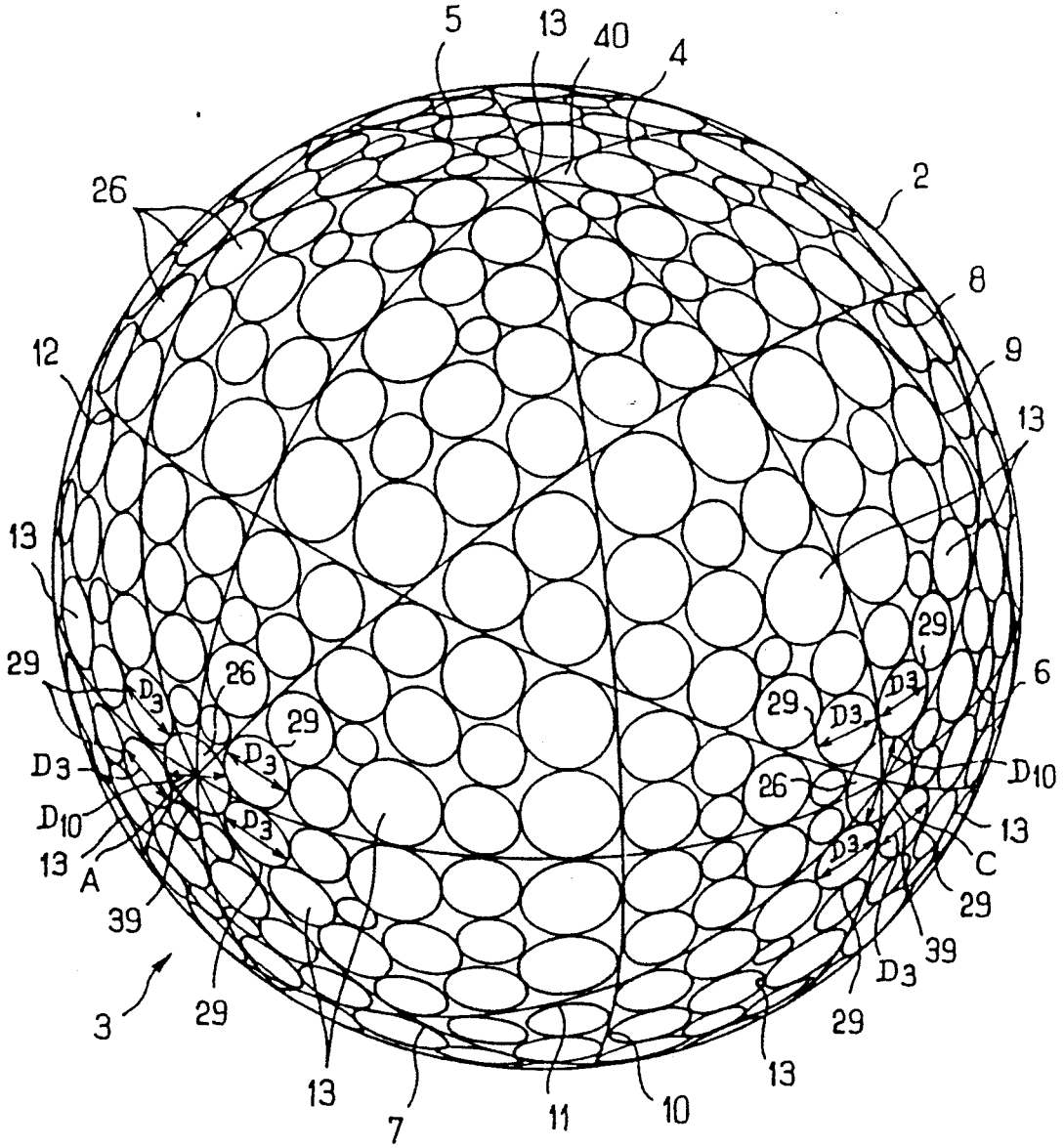

FIG. 5 illustrates a golf ball 203 identical to that which has been described with reference to FIG. 3 except that it comprises four supplemental dimples 26 respectively provided around points A and C, which are visible and points A' and C', which are not visible. Each of these supplemental dimples 26 defines by virtue of its intersection with the peripheral spherical surface 2 of the golf ball 203 a respective circle of intersection 39 having a diameter $D_{10}$ discussed above, adjacent to a respective circle of intersection 29, of diameter $D_3$, of four first elementary surfaces 13. In this case, only around points B and B' are there relatively substantial fields 40 of the peripheral spherical surface 2 of the golf ball 203, while the equatorial circles 9 and 10 remain free of any dimples 26.

Naturally, one can however select other arrangements of the circles of intersection with the various elementary surfaces and, if desired, the mutual points of intersection of the equatorial circles 4–12, combined with a different selection of respective diameters of these circles of intersection, without going beyond the scope of the present invention.

The instant application is based upon French application 90 06131, filed May 16, 1990, the disclosure of which is hereby specifically incorporated by reference thereto, including the drawings annexed thereto, and whose priority under 35 U.S.C. 119 is hereby claimed.

Finally, although the invention has been described with reference to particular means, materials and embodiments, it is to be understood that the invention is not limited to the particulars disclosed and extends to all equivalents within the scope of the claims.

What is claimed is:

1. A golf ball comprising:

a peripheral surface having the general shape of a sphere and a plurality of dimples provided in said peripheral surface, said dimples defining, by virtue of respective intersections between said dimples and said peripheral surface, circles of intersection distributed in a repeating pattern and generally bounded within elementary surfaces defined by arcs of nine equatorial circles of the sphere, said nine equatorial circles comprising:

three equatorial circles, defining intersections with the sphere of three equatorial planes, said three equatorial planes being secant, two by two, at right angles, along axes that are themselves secant two by two, at right angles, to the center of the sphere;

six equatorial circles distributed into three groups of two equatorial circles, the two equatorial circles of each of said groups being associated, respectively, with one of said three equatorial planes, each of said two equatorial circles of said groups of equatorial circles intersecting a respective one of said axes and being mutually symmetrical with a respective one of said equatorial planes, and each of said two equatorial circles of each of said three groups being angularly offset with respect to a respective equatorial plane by an identical angle $\alpha$ which is not 0° and is less than 90°, and which is different from 45° so that arcs of said nine equatorial circles define:

twenty-four first elementary surfaces, each of said twenty-four first elementary surfaces being either identical or mirror images with respect to said three equatorial planes, and each of said twenty-four first elementary surfaces comprising an irregular quadrilateral having a right angle;

eight second identical elementary surfaces, each of said eight second identical elementary surfaces being in the form of an equilateral triangle; and twenty-four third elementary surfaces, each of said twenty-four third elementary surfaces being either identical or mirror images with respect to said three equatorial planes, and each of said twenty-four third elementary surfaces comprising a spherical right triangle.

2. The golf ball as defined by claim 1, at least one of said equatorial circles not intersecting with any of said circles of intersection.

3. The golf ball as defined by claim 2, each of said equatorial circles subdividing each of the other equatorial circles into two equatorial circle arcs, each of which corresponding to one of the two hemispheres defined by said equatorial circles, and said equatorial circle arcs of one of the hemispheres being angularly offset with respect to the equatorial circle arcs respectively corresponding to the other hemispheres, by the same value around the axis of said equatorial circle.

4. The golf ball as defined by claim 2, none of said equatorial circles intersecting with any of said circles of intersection.

5. The golf ball as defined by claim 1, comprising circles of intersection at certain mutual intersections of said equatorial circles.

6. The golf ball as defined by claim 1, said circles of intersection being distributed in an identical pattern in said identical elementary surfaces and in a pattern constituting a mirror images of said identical pattern in said elementary surfaces that constitute mirror images of said identical elementary surfaces.

7. The golf ball as defined by claim 1, said angle $\alpha$ being approximately 34°47′.

8. A golf ball comprising:

a peripheral surface, generally having the shape of a sphere, said peripheral surface having a plurality of dimples, said dimples being arranged in predetermined patterns generally within a plurality of elementary surfaces defined by arcs of nine equatorial circles of said sphere, said plurality of elementary surfaces comprising:

a plurality of first elementary surfaces in the form of spherical quadrilaterals;

a plurality of second elementary surfaces in the form of first spherical triangles; and a plurality of third elementary surfaces in the form of second spherical triangles having a shape different from said first spherical triangles.

9. The golf ball as defined in claim 8, each of the spherical quadrilaterals being an irregular spherical quadrilateral having a right angle.

10. The golf ball as defined in claim 8, each of the first spherical triangles being a spherical equilateral triangle.

11. The gold ball as defined in claim 8, each of the second spherical triangles being a spherical right triangle.

12. The golf ball as defined in claim 8, each of the spherical quadrilaterals being an irregular spherical quadrilateral having a right angle, each of the first spherical triangles being a spherical equilateral triangle, and each of the second spherical triangles being a spherical right triangle.

13. The golf ball as defined in claim 8, the plurality of first elementary surfaces equalling twenty-four, the plurality of second elementary surface equalling eight, and the plurality of third elementary surfaces equalling twenty-four.

14. The golf ball as defined in claim 8, wherein:

(a) said plurality of first elementary surfaces comprises:

(i) a first plurality of identical first elementary surfaces in the form of spherical quadrilaterals;

(ii) a second plurality of identical first elementary surfaces in the form of spherical quadrilaterals, said second plurality of first elementary surfaces comprising respective mirror images of said first plurality of first elementary surfaces;

(b) said plurality of second elementary surfaces comprises;

(i) a first plurality of identical second elementary surfaces in the form of spherical triangles;

(ii) a second plurality of identical second elementary surfaces in the form of spherical triangles, said second plurality of identical second elementary surfaces comprising respective mirror images of said first plurality of identical second elementary surfaces; and (c) said plurality of third elementary surfaces comprises:

(i) a first plurality of identical third elementary surfaces in the form of spherical triangles;

(ii) a second plurality of identical third elementary surfaces in the form of spherical triangles, said second plurality of identical third elementary surfaces comprising respective mirror images of said first plurality of identical third elementary surfaces.

15. The golf ball as defined in claim 8, said plurality of first elementary surfaces equalling twenty-four, said plurality of second elementary surfaces equalling eight, sand said plurality of third elementary surfaces equalling twenty-four.

16. The golf ball as defined in claim 8, each of said plurality of first elementary surfaces containing thirteen dimples, each of said plurality of second elementary surfaces containing three dimples, and each of said plurality of third elementary surfaces containing six dimples.

17. The golf ball as defined in claim 16, having a diameter of approximately 42.67 mm.

18. The golf ball as defined in claim 8, said plurality of dimples comprising a plurality of dimples of different diameters.

19. The golf ball as defined in claim 18, each of said plurality of first elementary surfaces containing dimples of seven different diameters, each of said plurality of second elementary surfaces containing dimples of a single diameter, and each of said plurality of third elementary surfaces containing dimples of four different diameters.

20. The golf ball as defined in claim 8, comprising a further plurality of dimples, each of said further plurality of dimples containing a respective intersection of a plurality of said equatorial circles of said sphere.

* * * * *